US007503392B2

(12) United States Patent
King et al.

(10) Patent No.: US 7,503,392 B2
(45) Date of Patent: Mar. 17, 2009

(54) DEFORMABLE BALL SEAT

(75) Inventors: James G. King, Kingwood, TX (US); David B Ruddock, Pearland, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/891,713

(22) Filed: Aug. 13, 2007

(65) Prior Publication Data

US 2009/0044949 A1 Feb. 19, 2009

(51) Int. Cl.
*E21B 34/06* (2006.01)

(52) U.S. Cl. ..... 166/373; 166/318; 166/326; 137/845; 137/533.11; 251/334

(58) Field of Classification Search ..... 166/318, 166/326, 373, 382; 137/857, 504, 517, 515, 137/516.25, 516.27, 516.29, 519.5, 845, 137/533.11; 251/358, 359, 364, 334; 138/45
See application file for complete search history.

(56) References Cited

U.S. PATENT DOCUMENTS 2,769,454 A * 11/1956 Bletcher et al. ..... 137/119.04
2,973,006 A * 2/1961 Nelson ..... 137/493.9
3,007,527 A * 11/1961 Nelson ..... 166/326
3,211,232 A 10/1965 Grimmer
3,510,103 A * 5/1970 Carsello ..... 251/333
3,566,964 A * 3/1971 Livingston ..... 166/326
3,667,505 A 6/1972 Radig
3,727,635 A * 4/1973 Todd ..... 137/513.5
3,901,315 A 8/1975 Parker et al.
4,160,478 A 7/1979 Calhoun et al.
4,291,722 A 9/1981 Churchman
4,390,065 A 6/1983 Richardson
4,448,216 A 5/1984 Speegle et al.

(Continued)

FOREIGN PATENT DOCUMENTS

GB 2281924 A 3/1995

(Continued)

OTHER PUBLICATIONS

StageFRAC Maximize Reservoir Drainage, 2007, pp. 1-2, Schlumberger, U.S.A.

(Continued)

*Primary Examiner*—Kenneth Thompson
*Assistant Examiner*—Cathleen R Hutchins
(74) *Attorney, Agent, or Firm*—Greenberg Traurig LLP; Anthony F. Matheny

(57) ABSTRACT

Apparatuses for restricting fluid flow through a well conduit comprise a housing having a longitudinal bore and a collapsible seat disposed within the bore. The seat has a first position defining a first seat inner diameter when the apparatus is in the run-in position and a second position defining a second seat inner diameter when the apparatus is in the set position. The first seat inner diameter is greater than the second seat inner diameter. A plug element is adapted to be disposed into the bore and landed on the seat to move the seat from the first position to the second position. While in the second position, the seat restricts fluid flow through the bore and provides additional support to the plug member landed on the seat.

20 Claims, 2 Drawing Sheets

U.S. PATENT DOCUMENTS

| | | | | |
|---|---|---|---|---|
| 4,537,383 | A | 8/1985 | Fredd | |
| 4,576,234 | A | 3/1986 | Upchurch | |
| 4,669,538 | A * | 6/1987 | Szarka | 166/120 |
| 4,826,135 | A * | 5/1989 | Mielke | 251/333 |
| 5,056,599 | A | 10/1991 | Comeaux et al. | |
| 5,297,580 | A * | 3/1994 | Thurman | 137/533.15 |
| 5,704,393 | A | 1/1998 | Connell et al. | |
| 5,762,142 | A | 6/1998 | Connell et al. | |
| 5,813,483 | A | 9/1998 | Latham et al. | |
| 5,960,881 | A | 10/1999 | Allamon et al. | |
| 6,155,350 | A | 12/2000 | Melenyzer | |
| 6,530,574 | B1 | 3/2003 | Bailey et al. | |
| 6,547,007 | B2 | 4/2003 | Szarka et al. | |
| 6,668,933 | B2 | 12/2003 | Kent | |
| 6,866,100 | B2 | 3/2005 | Gudmestad et al. | |
| 6,896,049 | B2 | 5/2005 | Moyes | |
| 2005/0061372 | A1 | 3/2005 | McGrath et al. | |
| 2005/0126638 | A1 * | 6/2005 | Gilbert | 137/539 |
| 2005/0205264 | A1 | 9/2005 | Starr et al. | |
| 2006/0175092 | A1 | 8/2006 | Mashburn | |
| 2007/0023087 | A1 | 2/2007 | Krebs et al. | |
| 2008/0217025 | A1 | 9/2008 | Ruddock et al. | |

FOREIGN PATENT DOCUMENTS

| | | |
|---|---|---|
| WO | WO 00/15943 | 3/2000 |

OTHER PUBLICATIONS

Brad Musgrove, Multi-Layer Fracturing Solution Treat and Produce Completions, Nov. 12, 2007, pp. 1-23, Schlumberger, U.S.A.

G.L. Rytlewski, A Study of Fracture Initiation Pressures in Cemented Cased-Hole Wells Without Perforations, May 15, 2006, pp. 1-10, SPE 100572, Society of Petroleum Engineers, U.S.A.

* cited by examiner

DEFORMABLE BALL SEAT

BACKGROUND

1. Field of Invention

The present invention is directed to ball seats for use in oil and gas wells and, in particular, to deformable ball seats having a collapsible seat that increases support to the ball.

2. Description of Art

Ball seats are generally known in the art. For example, typical ball seats have a bore or passageway that is restricted by a seat. The ball or drop plug is disposed on the seat, preventing or restricting fluid from flowing through the bore of the ball seat and, thus, isolating the tubing or conduit section in which the ball seat is disposed. As the fluid pressure above the ball or drop plug builds up, the conduit can be pressurized for tubing testing or actuating a tool connected to the ball seat such as setting a packer. Ball seats are also used in cased hole completions, liner hangers, frac systems, flow diverters, and flow control equipment and systems.

Although the terms "ball seat" and "ball" are used herein, it is to be understood that a drop plug or other shaped plugging device or element may be used with the "ball seats" disclosed and discussed herein. For simplicity it is to be understood that the term "ball" includes and encompasses all shapes and sizes of plugs, balls, or drop plugs unless the specific shape or design of the "ball" is expressly discussed.

As mentioned above, all seats allow a ball to land and make a partial or complete seal between the seat and the ball during pressurization. The contact area between the ball and the inner diameter of the seat provides the seal surface. Generally, the total contact area or bearing surface between the ball and the seat is determined by the outer diameter of the ball and the inner diameter of seat. The outer diameter of the contact area is determined by the largest diameter ball that can be transported down the conduit. The inner diameter of the seat is determined by the allowable contact stress the ball can exert against the contact area and/or the required inner diameter to allow preceding passage of plug elements or tools, and/or subsequent passage of tools after the plug element is removed, through the inner diameter of the seat.

The seat is usually made out of a metal that can withstand high contact forces due to its high yield strength. The ball, however, is typically formed out of a plastic material that has limited compressive strength. Further, the contact area between the ball and seat is typically minimized to maximize the seat inner diameter for the preceding passage of balls, plug elements, or other downhole tools. Therefore, as the ball size becomes greater, the contact stresses typically become higher due to the increasing ratio of the cross-section of the ball exposed to pressure compared to the cross-section of the ball in contact with the seat. This higher contact pressure has a propensity to cause the plastic balls to fail due to greater contact stresses.

The amount of contact pressure a particular ball seat can safely endure is a direct function of the ball outer diameter, seat inner diameter, applied tubing pressure, and ball strength. Because of limited ball strength as discussed above, the seat inner diameter is typically reduced to increase the contact area (to decrease contact stress). The reduced seat inner diameter forces the ball previously dropped through the seat inner diameter to have a smaller outer diameter to pass through this seat inner diameter. This reduction in outer diameter of previous balls continues throughout the length of conduit until ball seats can no longer be utilized. Therefore, a string of conduit is limited as to the number of balls (and, thus ball seats) that can be used which reduces the number of actuations that can be performed through a given string of conduit.

SUMMARY OF INVENTION

Broadly, ball seats having a housing, a collapsible seat, and a plug element such as a ball are disclosed. Typically, the ball is landed and the conduit is pressurized to a predetermined pressure. Upon pressurization of the conduit so that the ball is pushed into the seat, the seat collapses to provide additional support to the ball as it is being pressurized. In other words, the force of the ball into the seat by the pressure in the tubing or conduit causes the seat to collapse inward toward the centerline (or axis) of the bore of the ball seat and into its collapsed position. In the collapsed position, more surface area of the seat is available to support the ball, thus providing additional support to ball compared to a non-collapsible seat. The collapsed seat may support the ball by increasing the surface area of the seat in direct contact or engagement with the ball. Alternatively, portions of the collapsed seat may not directly contact or engage the ball, but instead, provide indirect support to the plug element engagement surface which is in direct engagement with the ball so that the collapsed seat distributes the force acting on the ball over a larger area, thus, allowing the seat to withstand higher pressures. Additionally, the ball, while not initially contacting portions of the collapsed seat, may subsequently come into contact with portions of the collapsed seat as pressure increases and the ball deforms and extrudes through the seat inner diameter. Further, the additional support provided by the collapsed seat is not necessarily a sealing engagement, but it can be. The applied pressure to the now collapsed seat decreases the likelihood that the force on the ball will push the ball through the seat.

Due to the collapsed seat providing additional support to the ball, the ball seats disclosed herein provide a plugging method where higher pressure can be exerted onto a seat by a lower strength ball without exceeding the ball's bearing or load strength. Further, the contact pressure resulting from having force distribution over a larger area provided by the collapsed seat can be effectively reduced without affecting the sealability of the ball.

In one embodiment, apparatus for restricting flow through a well conduit is disclosed. The apparatus comprises a housing having a longitudinal bore and a collapsible seat disposed within the bore, the collapsible seat having a first position defining a first seat inner diameter when the apparatus is in the run-in position and a second position defining a second seat inner diameter when the apparatus is in the set position, the first seat inner diameter being greater than the second seat inner diameter so that the collapsible seat restricts fluid flow through the bore when the seat is in the second position; and a plug element adapted to be disposed into the bore and landed on the collapsible seat to move the collapsible seat from the first position to the second position.

A further feature of the apparatus is that the apparatus may further comprise a deformable element disposed on the collapsible seat. Another feature of the apparatus is that the deformable element may be a sleeve disposed adjacent the collapsible seat. An additional feature of the apparatus is that the deformable element may be in sliding engagement with an inner wall surface of the bore. Still another feature of the apparatus is that the deformable material may be in sliding engagement with an upper surface of the collapsible seat. A further feature of the apparatus is that the collapsible seat may completely close the bore such that the second seat inner diameter is eliminated. Another feature of the apparatus is that the collapsible seat may comprise a shape-memory material. An additional feature of the apparatus is that the collapsible seat may have a Y-shape with a flared upper portion. Still another feature of the apparatus is that the collapsible seat may comprise a frusto-conical shape.

In another embodiment of the apparatus for restricting flow through a well conduit, the apparatus comprises a housing having a longitudinal bore with a seat pivotally connected to an inner wall surface of the bore, the seat comprising a deformable ring and having a first position defining a first seat inner diameter and a second position defining a second seat inner diameter, the first seat inner diameter being greater than the second seat inner diameter; and a plug element adapted to be disposed into the bore and landed on the seat to move the seat from the first position to the second position causing the seat to restrict fluid flow through the bore.

A further feature of the apparatus is that the deformable ring may be permanently deformed when in the second position. Another feature of the apparatus is that seat may further comprise a deformable material disposed on an upper surface of the deformable ring for engagement with the plug member. An additional feature of the apparatus is that the deformable element may be in sliding engagement with an inner wall surface of the bore and with the upper surface of the deformable ring. Still another feature of the apparatus is that the deformable ring may comprise a frusto-conical shape. A further feature of the apparatus is that the deformable ring may have a Y-shape with a flared upper portion. Another feature of the apparatus is that the deformable ring may comprise a shape-memory material.

In another embodiment, a method of restricting a bore of a conduit disposed in a wellbore of a well is disclosed. The method comprises the steps of: (a) providing a seat disposed within a housing having a longitudinal bore, the seat the seat comprising a first position defining a first seat inner diameter and a second position defining a second seat inner diameter, the first seat inner diameter being greater than the second seat inner diameter; (b) lowering the seat on a string of conduit into a wellbore of a well; (c) inserting a plug member into the conduit and landing the plug member on the seat; and (d) moving the seat from the first position to the second position causing restriction of the bore by the seat due to the seat moving from the first position to the second position.

A further feature of the method is that the method may further comprise the step of pumping fluid into the conduit forcing the plug element into the seat to redirect the fluid flow out of the conduit. Another feature of the method is that the method may further comprise the step of pumping fluid into the conduit forcing the plug element into the seat to actuate a downhole tool disposed above the seat in the string of conduit by fluid pressure within the conduit. An additional feature of the method is that step (d) may cause the bore to be completely blocked by the seat being in its second position.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
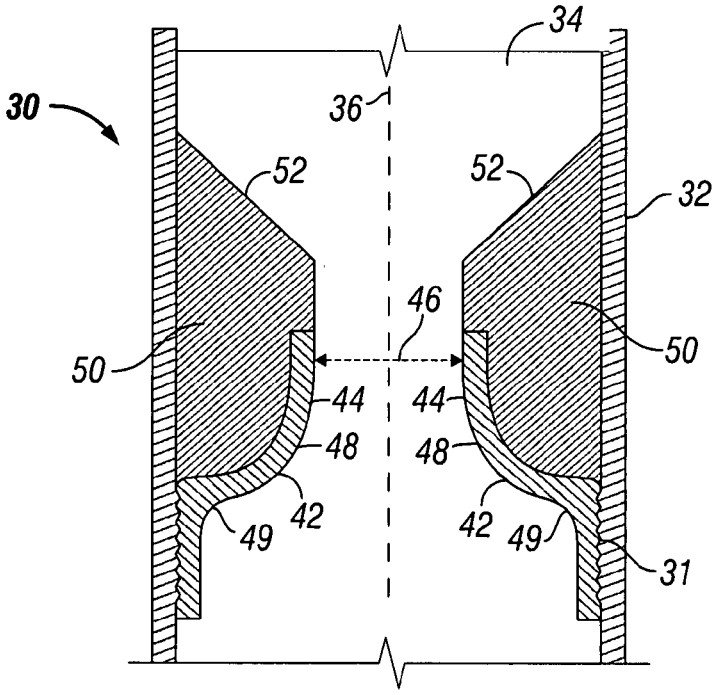
FIG. 1 is a cross-sectional view of a specific embodiment of a ball seat disclosed herein shown in the run-in position.
Figure 2:
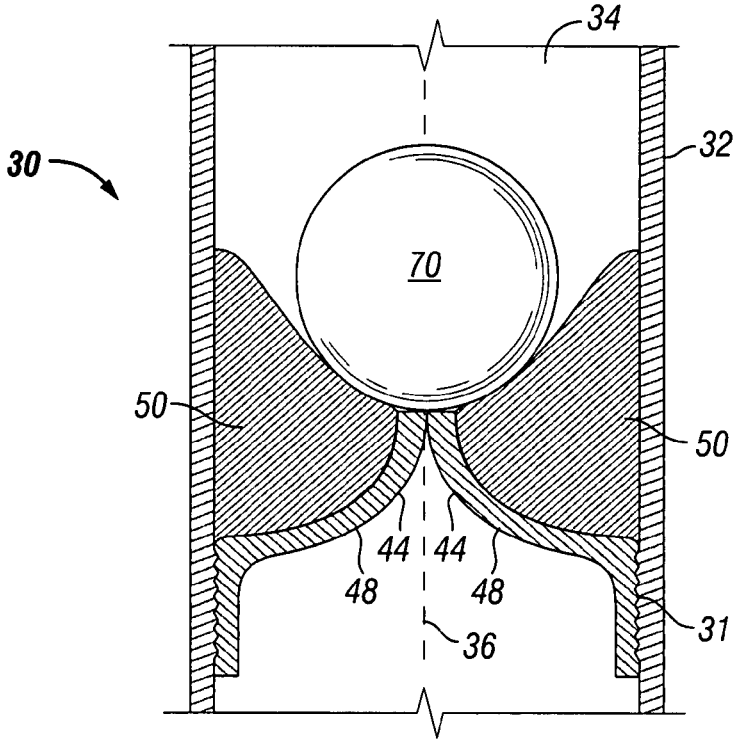
FIG. 2 is a partial cross-sectional view of the ball seat shown in FIG. 1 shown in the actuated or set position.

Referring now to FIGS. 1-2, in one embodiment, ball seat 30 includes a sub or housing 32 having bore 34 defined by an inner wall surface and having axis 36. Attachment members such as threads (not shown) or gripping members (not shown) may be disposed along the outer diameter of each end of housing 32 for securing ball seat 30 into a string of conduit, such as drill pipe or tubing.

The inner diameter wall surface of housing 34 includes deformable ring 42 that extends inward toward axis 36 to form seat 44 for receiving plug element 70, shown as a ball in FIG. 2. Ring 42 may be secured to the inner wall surface of housing 32 by attachment members such as threads 31 or gripping members (not shown). Alternatively, ring 42 may be formed integral, i.e., part of the same structure, as housing 32 (not shown). Due to ring 42 being deformable, seat 44 is a collapsible seat that, as discussed in greater detail below, bends inwardly when plug element 70 is landed on seat 44. In the embodiment of FIGS. 1-2, deformable ring 42 has a frusto-conical shape.

Seat 44 has seat inner diameter 46 in its first position (FIG. 1) and a second inner diameter (shown in FIG. 2 as being equal to a measurement of 0) in its second, or collapsed, position (FIG. 2). Second inner diameter is not identified in FIG. 2 because it has been completely eliminated, i.e., reduced to a measurement of 0, due to the collapse of seat 44. It is to be understood, however, that the second seat inner diameter is not required to be eliminated and may be measurable. In other words, seat inner diameter 46 is not required to be completely closed or restricted in the second position.

Figure 3:
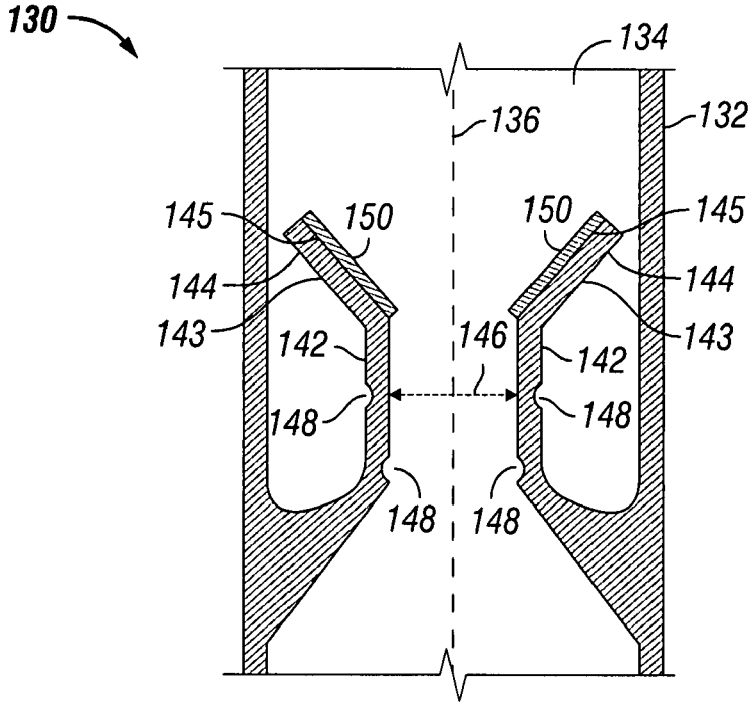
FIG. 3 is a cross-sectional view of another specific embodiment of a ball seat disclosed herein shown in the run-in position.
Figure 4:
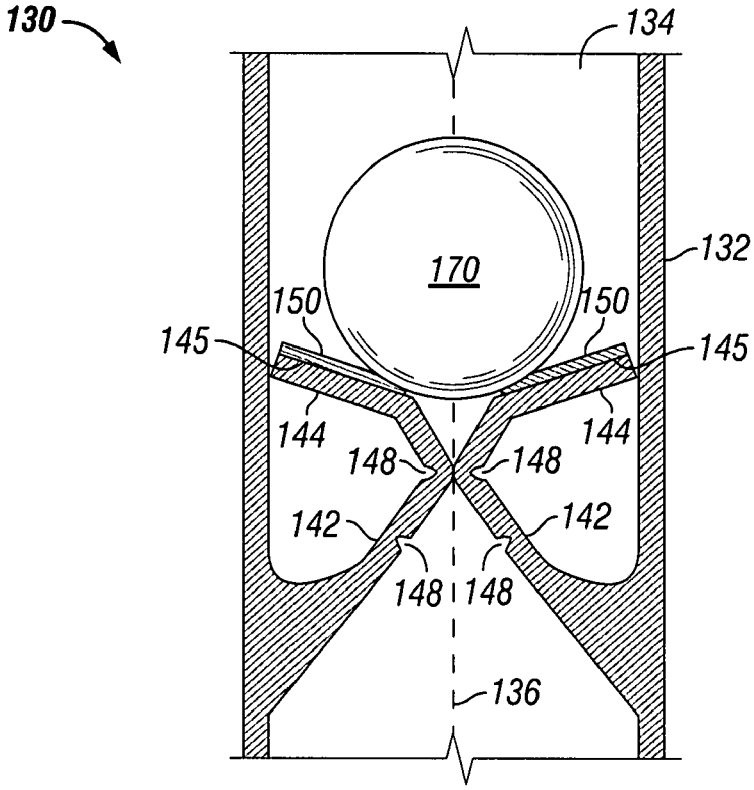
FIG. 4 is a partial cross-sectional view of the ball seat shown in FIG. 3 shown in the actuated or set position.

Ring 42 is formed out of a material that is bendable at bend points, shown in FIGS. 1-2 generally as bend points 48. Ring 42 may also be bendable at bend points 49 as well as along the length of ring 42 between bend points 48, 49 or along the entire length of ring 42. In one specific embodiment (not shown), bend points 48, 49 are shaped to promote bending at a pre-determined point (see discussion below with respect to bend points 148 (FIGS. 3-4). Alternatively, ring 42 may include one or more grooves (not shown) to facilitate movement of ring 42 and, thus, seat 44, to the collapsed position (FIG. 2).

To provide sufficient rigidity in the run-in position (FIG. 1), yet facilitate bending or collapsing into set or collapsed position (FIG. 2), deformable ring may be formed from a material such as steel, annealed steel, work hardenable steel, aluminum, copper, or lead.

As shown in FIGS. 1-2, in addition to ring 42, seat 44 includes deformable element 50 having plug element engagement surface 52 for engaging plug element 70 (FIG. 2). Deformable element 50 may be formed, in whole or in part, from one or more deformable material such as an elastomer, a polymer, or other deformable material that will change shape to facilitate collapsing seat 44. Suitable deformable materials include, but are not limited to nitrile, carboxylated nitrile, hydrogenated nitrile butyl rubber, AFLAS® fluoropolymers and fluoroelastomers such as those available from AGC Chemicals America, Inc. located in Bayonne, N.J., EPDM, viton, lead, and steel wool mesh. In one particular embodiment, the deformable material is an elastomer or polymer that facilitates creation of a sealing engagement between plug element engagement surface 52 of deformable element 50 and plug element 70 (FIG. 2). As shown in FIGS. 1-2, deformable element 50 is a sleeve in sliding engagement with the inner wall surface of housing 32 and an upper surface of ring 42.

Seat 44 may be shaped to form an engagement surface with plug element 70 that is reciprocal in shape to the shape of the plug element 70 (shown in FIG. 2 as a ball) when seat 44 is in the second or collapsed position. For example, plug element 70 may be spherically-shaped (as shown in FIG. 2) and seat 44 may include an arc shape (not shown) when collapsed. In the embodiments in which seat 44 includes deformable element 50, deformable element 50 may include an arc shape (not shown) when seat 44 is in the second position or, alternatively, the deformable material forming deformable element 50 may be shapeable or deformable to form an arc shape reciprocal to the spherical ball shape of plug element 70. In other embodiments, ring 42 either alone or together with deformable element 50 may form engagement surfaces with plug element 70 so that both ring 42 and deformable element 50 may be reciprocally shaped to receive plug element 70. As mentioned above, however, although plug element 70 is shown as a spherical ball in FIG. 2, it is to be understood that plug element 70 may be a drop plug, dart, or any other plug element known to persons of ordinary skill in the art.

In one operation of this embodiment, ball seat 30 is disposed in a string of conduit with a downhole tool (not shown), such as a packer or a pressure activated sleeve located above ball seat 30. The string of conduit is run-in a wellbore until the string is located in the desired position. Plug element 70 is dropped down the string of conduit and landed on seat 44 and, in particular, into engagement with deformable material 50. Fluid, such as hydraulic fluid, is pumped down the string of conduit causing downward force or pressure to act on plug element 70. When the pressure or downward force of the fluid above seat 44 reaches a certain, usually predetermined, pressure, seat 44 collapses due to ring 42 bending inwardly at bend points 48, 49 or continuously along the length of ring 42. As will be recognized by persons in the art, bend points 48, 49 act similarly to pivot points because ring 42 "rotate" around these points. However, it is to be understood, that the inwardly bending at bend points 48, 49 do not need to be rotational bending.

As shown in FIG. 2, more bending of ring 42 occurs at bend points 48 compared to bend points 49. Thus, ring 42 extends inward toward axis 36 to restrict fluid flow through bore 34. As seat 44 collapses, deformable material 50 is deformed reciprocally to ring 42 and plug element 70.

In the embodiment shown in FIGS. 1-2, plug element 70 and the increased pressure acting downwardly on seat 44 deforms seat 44. When seat 44 is deformed, plug element 70 is supported by seat 44 that blocks a larger surface area of seat inner diameter 46. In other words, collapsed seat 44 decreases seat inner diameter 46 and, thus, restricts fluid flow through bore 34. For example, in the first position (FIG. 1), a measurable seat inner diameter 46 is available to allow fluid flow through seat 44. In the second or collapsed position shown in FIG. 2, however, seat 44 is collapses such that seat 44 no longer has a seat inner diameter. In other words, second seat inner diameter is eliminated because second seat inner diameter has a measurement of 0. It is to be understood, however, that second seat inner diameter may be measurable, i.e., not 0 or eliminated, because collapsed seat 44 does not completely restrict bore 34.

By closing or lessening seat inner diameter 46 with seat 44, a larger force distribution area of seat 44 is available to distribute the force acting on plug element 70 and, thus, provide increased support to plug element 70 so that higher fluid pressures can be exerted onto plug element 70 without failure of plug element 70 or ball seat 30.

In one specific embodiment, seat 44 is permanently deformable. In another embodiment, seat 44 is formed from a shape-memory material so that it can return to its original run-in shape after plug element 70 is removed, i.e., the downward fluid pressure is released.

Referring now to FIGS. 3-4, in another embodiment ball seat 130 includes a sub or housing 132 having bore 134 defined by an inner wall surface and having axis 136. Attachment members such as threads (not shown) or gripping members (not shown) may be disposed along the outer diameter of each end of housing 132 for securing ball seat 130 into a string of conduit, such as drill pipe or tubing.

The inner diameter wall surface of housing 134 includes deformable ring 142 that extends inward toward axis 136 to form seat 144 for receiving plug element 170, shown as a ball in FIG. 4. Like the embodiment shown in FIGS. 1-2, ring 142 may be secured to the inner wall surface of housing 132 by attachment members such as threads (not shown) or gripping members (not shown). Alternatively, as illustrated in FIGS. 3-4, ring 142 may be formed integral, i.e., part of the same structure, as housing 132. Due to ring 142 being deformable, seat 144 is a collapsible seat that, as discussed in greater detail below, bends inwardly when plug element 170 is landed on seat 144.

In the embodiment of FIGS. 3-4, seat 144 has a Y-shape with upper flange portion 143. Seat 144 also has a first position (FIG. 3) defining seat inner diameter 146 and a second, or collapsed, position (FIG. 4) defining a second seat inner diameter. Second seat inner diameter is shown in FIG. 4 has having a measurement of 0 because it has been eliminated by the collapse of seat 144 completely bore 134.

Seat 144 is formed out of a material that is bendable at bend points 148. In the specific embodiment shown, bend points 148 are "C-shaped" or scallop-shaped to promote bending at specific pre-determined points identified at bend points 148. Bend points 148 may have other shapes as desired or necessary to facilitate bending at specific locations. In one specific embodiment, not shown, ring 142 includes one or more grooves (not shown) to facilitate movement of ring 142 and, thus, seat 144, to the collapsed position (FIG. 4).

To provide sufficient rigidity in the run-in position (FIG. 3), yet facilitate bending or collapsing into set or collapsed position (FIG. 4), ring 142 may be formed of any of the materials listed above with respect to ring 42.

As shown in FIGS. 3-4, seat 144 includes plug element engagement surface 145 for engaging plug element 170 (FIG. 4). In one particular embodiment (not shown), engagement surface 145 is reciprocally shaped to the shape of plug element 170 (shown in FIG. 4 as a ball). Thus, in such an embodiment, plug element 170 is spherically-shaped and seat 144 includes engagement surface 145 that is arc shaped (not shown). As mentioned above, however, although plug element 170 is shown as a ball in FIG. 4, it is to be understood that plug element 170 may be a drop plug, dart, or any other plug element known to persons of ordinary skill in the art.

In another embodiment, plug element engagement surface 145 may include a rubber or polymer or elastomer coating layer 150 to facilitate plug element 170 engaging with seat 144. The coating may be a deformable element such as those discussed above with respect to FIGS. 1-2 or simply a non-slip coating applied to plug element engagement surface 145.

In one operation of this embodiment, ball seat 130 is disposed in a string of conduit with a downhole tool (not shown), such as a packer or a pressure activated sleeve located above ball seat 130. The string of conduit is run-in a wellbore until the string is located in the desired position. Plug element 170 is dropped down the string of conduit and landed on seat 144 and, in particular, into engagement with engagement surface 145. Fluid, such as hydraulic fluid, is pumped down the string of conduit causing downward force or pressure to act on plug element 170. When the pressure or downward force of the fluid above seat 144 reaches a certain, usually predetermined, pressure, seat 144 collapses due to ring 142 bending at bend points 148. Thus, ring 142 extends inward toward axis 136 to restrict fluid flow through bore 134. As seat 144 collapses, bore 134 is restricted by seat 144.

In the embodiment shown in FIGS. 3-4, plug element 170 and the increased pressure acting downwardly on seat 144 deforms seat 144 to decrease seat inner diameter 146 and, thus, restrict fluid flow through bore 134. In one specific embodiment, seat 144 is permanently deformable. In another embodiment, seat 144 is formed from a shape-memory material so that it can return to its original run-in shape after plug element 170 is removed, i.e., the downward fluid pressure is released.

When seat 144 is deformed, plug element 170 is supported by a seat that blocks a larger surface area of seat inner diameter 146. For example, in the first position (FIG. 1), a measurable seat inner diameter 146 is available to allow fluid flow through seat 144. In the second or collapsed position (FIG. 4), however, seat 44 collapses such that seat 144 no longer has a seat inner diameter, i.e., second seat inner diameter has a measurement of 0. It is to be understood, however, that second seat inner diameter may be measurable, i.e., not 0 or eliminated, because collapsed seat 144 does not completely restrict bore 134.

By closing or lessening first seat inner diameter 146 with seat 144, a larger force distribution area of seat 144 is available to distribute the force acting on plug element 170 and, thus, provide increased support to plug element 170 so that higher fluid pressures can be exerted onto plug element 170 without failure of plug element 170 or ball seat 130.

With respect to the embodiments shown in FIGS. 1-4, after actuation of a downhole tool by the increased pressure of the fluid above plug elements 70, 170, or after the increased pressure of the fluid above plug elements 70, 170 has been used for its intended purpose, the conduit no longer needs to be restricted and plug elements 70, 170 can be removed. Plug elements 70, 170 can be removed through methods and using devices known to persons of ordinary skill in the art, e.g., milling, dissolving, or fragmenting plug elements 70, 170. Alternatively, plug elements 70, 170 may be lightweight "float" plug elements such that, when pressure is reduced, plug elements 70, 170 are permitted to float up to the top of the well.

Seats 44, 144 may be removed through any method or using any device know to persons of ordinary skill in the art. In one embodiment, a mill device is used to mill seats 44, 144, and if present, plug elements 70, 170. Because seats 44, 144 collapse into seat inner diameters 46, 146, seats 44, 146, deformable element 50, and plug elements 70, 170 may be formed out of materials that are less rigid and, thus, easily milled, while permitting continued restriction of the conduit at high pressures. For example, high density plastics and soft metals such as galvanized aluminum may be used which are much easier to mill compared to titanium, steel, and other hard metals. Alternatively, seats 44, 144, and deformable element 50, may be formed out of shape-memory materials so that the reduction of downward fluid pressure allows plug elements 70, 170 to release from seats 44, 144, respectively, and seats 44, 144 to return to their first or run-in position (FIGS. 1 and 3). In such embodiments, ball seats 30, 130 are reusable.

Further, as will be understood by persons skilled in the art, ball seats 30 and 130 are not required to completely block, or prevent fluid flow through bores 34 and 134, respectively. In other words, the engagement of seats 44 and 144 with plug elements 70, 170 do not have to close bore 34, 134 by forming leak-proof seals. Thus, the restriction of fluid flow through bores 34, 134 may be complete, i.e., the conduit is closed, or the restriction may be partial. All that is necessary is that fluid flow through bores 34, 134 is sufficiently restricted to allow fluid to build up above plug elements 70, 170 until the pressure is sufficiently great to actuate a downhole tool, divert flow at a sufficient pressure to perform whatever function is needed, e.g., frac a well formation, or perform whatever other procedure that is desired.

It is to be understood that the invention is not limited to the exact details of construction, operation, exact materials, or embodiments shown and described, as modifications and equivalents will be apparent to one skilled in the art. For example, the size and shape of the deformable ring of the seat can be any size or shape desired or necessary to be moved from the first position to the second position to provide support to the plug element. In one embodiment the deformable ring is not curved to form, as shown in FIGS. 1-2, a frusto-conical shape, but instead provides a straight intersection at an angle relative to the inner diameter wall surface of the housing. The angled intersection of the ring with the inner wall surface of the housing bends or pivots downward at the point of the intersection with the inner diameter wall surface to partially or completely close off or restrict the bore, thereby decreasing or eliminating the seat inner diameter. Further, the deformable ring of the seat may include a non-slip material to increase the frictional grip between the seat and the plug member. This non-slip material may also be a deformable element.

Moreover, a back-up element may be disposed below the deformable ring by attaching the back-up element to the inner wall surface of the housing. The back-up element may be a metal brace to assist the seat being bent or moved from the first position to the second position. Further, the back-up element may extend upward to support the deformable material.

Additionally, although the apparatuses described in greater detail with respect to FIGS. 1-4 are ball seats having a ball as their respective plug elements, it is to be understood that the apparatuses disclosed herein may be any type of seat known to persons of ordinary skill in the art that include a seat that restricts the seat inner diameter. For example, the apparatus may be a drop plug seat, wherein the drop plug temporarily restricts the flow of fluid through the wellbore. Therefore, the term "plug" as used herein encompasses a ball as shown in FIGS. 1-4, as well as any other type of device that is used to restrict the flow of fluid through a ball seat. Further, in all of the embodiments discussed with respect to FIGS. 1-4, upward, toward the surface of the well (not shown), is toward the top of FIGS. 1-4, and downward or downhole (the direction going away from the surface of the well) is toward the bottom of FIGS. 1-4. However, it is to be understood that the ball seats may have their positions rotated. Accordingly, the ball seats can be used in any number of orientations easily determinable and adaptable to persons of ordinary skill in the art. Accordingly, the invention is therefore to be limited only by the scope of the appended claims.

What is claimed is:

1. An apparatus for restricting flow through a well conduit, the apparatus comprising:

a housing having a longitudinal bore and a collapsible seat disposed within the bore, the collapsible seat having a first position defining a first seat inner diameter when the apparatus is in the run-in position and a second position defining a second seat inner diameter when the apparatus is in the set position, the first seat inner diameter being greater than the second seat inner diameter so that the collapsible seat restricts fluid flow through the bore when the seat is in the second position; and a plug element adapted to be disposed into the bore and landed on the collapsible seat to move the collapsible seat from the first position to the second position.

2. The apparatus of claim 1, further comprising a deformable element disposed on the collapsible seat.

3. The apparatus of claim 2, wherein the deformable element is a sleeve disposed adjacent the collapsible seat.

4. The apparatus of claim 2, wherein the deformable element is in sliding engagement with an inner wall surface of the bore.

5. The apparatus of claim 4, wherein the deformable material is in sliding engagement with an upper surface of the collapsible seat.

6. The apparatus of claim 1, wherein the collapsible seat completely closes the bore such that the second seat inner diameter is eliminated.

7. The apparatus of claim 1, wherein the collapsible seat comprises a shape-memory material.

8. The apparatus of claim 1, wherein the collapsible seat has a Y-shape with a flared upper portion.

9. The apparatus of claim 1, wherein the collapsible seat comprises a frusto-conical shape.

10. An apparatus for restricting flow through a well conduit, the apparatus comprising:

a housing having a longitudinal bore with a seat pivotally connected to an inner wall surface of the bore, the seat comprising a deformable ring and having a first position defining a first seat inner diameter and a second position defining a second seat inner diameter, the first seat inner diameter being greater than the second seat inner diameter; and a plug element adapted to be disposed into the bore and landed on the seat to move the seat from the first position to the second position causing the seat to restrict fluid flow through the bore.

11. The apparatus of claim 10, wherein the deformable ring is permanently deformed when in the second position.

12. The apparatus of claim 10, wherein the seat further comprises a deformable material disposed on an upper surface of the deformable ring for engagement with the plug member.

13. The apparatus of claim 12, wherein the deformable element is in sliding engagement with an inner wall surface of the bore and with the upper surface of the deformable ring.

14. The apparatus of claim 10, wherein the deformable ring comprises a frusto-conical shape.

15. The apparatus of claim 10, wherein the deformable ring has a Y-shape with a flared upper portion.

16. The apparatus of claim 10, wherein the deformable ring comprises a shape-memory material.

17. A method of restricting a bore of a conduit disposed in a wellbore of a well, the method comprising the steps of:

(a) providing a seat disposed within a housing having a longitudinal bore, the seat the seat comprising a first position defining a first seat inner diameter and a second position defining a second seat inner diameter, the first seat inner diameter being greater than the second seat inner diameter;

(b) lowering the seat on a string of conduit into a wellbore of a well;

(c) inserting a plug member into the conduit and landing the plug member on the seat; and (d) moving the seat from the first position to the second position causing restriction of the bore by the seat due to the seat moving from the first position to the second position.

18. The method of claim 17, further comprising the step of pumping fluid into the conduit forcing the plug element into the seat to redirect the fluid flow out of the conduit.

19. The method of claim 17, further comprising the step of pumping fluid into the conduit forcing the plug element into the seat to actuate a downhole tool disposed above the seat in the string of conduit by fluid pressure within the conduit.

20. The method of claim 17, wherein step (d) causes the bore to be completely blocked by the seat being in its second position.

* * * * *